US006732724B1

(12) United States Patent
Paulson et al.

(10) Patent No.: US 6,732,724 B1
(45) Date of Patent: May 11, 2004

(54) PORTABLE BALL THROWING APPARATUS

(75) Inventors: Kerry K. Paulson, Sherwood, OR (US); Durward E. De Chenne, Sherwood, OR (US)

(73) Assignee: Jugs, Inc., Tualatin, OR (US)

( * ) Notice: Subject to any disclaimer, the term of this patent is extended or adjusted under 35 U.S.C. 154(b) by 0 days.

(21) Appl. No.: 10/289,681

(22) Filed: Nov. 5, 2002

(51) Int. Cl.[7] ..... F41B 3/04
(52) U.S. Cl. ..... 124/6; 124/78
(58) Field of Search ..... 124/4, 6, 78; 473/422, 473/451, 454; 248/688, 676, 677, 127, 157, 163.1, 177.1

(56) References Cited

U.S. PATENT DOCUMENTS

| | | | | | |
|---|---|---|---|---|---|
| 3,774,584 | A | * | 11/1973 | Paulson | 124/78 |
| 4,080,950 | A | * | 3/1978 | Paulson et al. | 124/1 |
| 4,197,827 | A | * | 4/1980 | Smith | 124/78 |
| 4,760,835 | A | * | 8/1988 | Paulson et al. | 124/78 |
| 6,089,217 | A | * | 7/2000 | Paulson et al. | 124/78 |
| 6,093,117 | A | * | 7/2000 | Sherlock et al. | 473/422 |
| 6,164,271 | A | * | 12/2000 | Paulson et al. | 124/78 |
| 6,402,640 | B1 | * | 6/2002 | Stuart | 473/422 |

* cited by examiner

*Primary Examiner*—Kien Nguyen
(74) *Attorney, Agent, or Firm*—Olson and Olson

(57) ABSTRACT

The ball throwing apparatus of this invention is formed of a flat main frame plate which mounts a rotary ball throwing wheel and a confronting pad spaced from the wheel slightly less than the diameter of a ball to be thrown. The pad is mounted for adjusting said space for alternatively engaging and throwing baseballs and softballs. The main frame plate is mounted on the upper end of a vertical post by a first pivot for adjustable rotation about a horizontal axis for adjusting the curvature of flight of a thrown ball. The lower end of the post is mounted on a second pivot for rotation about a horizontal axis perpendicular to the first pivot for adjusting the trajectory of flight of a thrown ball, the bearing for the second pivot is mounted on a leg supporting cup for rotation about a vertical axis for adjusting the horizontal direction of a thrown ball. Tripod legs are secured removably to the cup and each leg is formed of at least two segments secured together removably in longitudinal extension for supporting the ball throwing wheel and pad at an elevation above ground for throwing baseballs. The lower segments of each leg is bent adjacent its lower end for engaging the ground or, in an alternative arrangement, for being secured to the cup in place of the upper leg segment, for supporting the ball throwing wheel and pad at a lower elevation above ground for throwing softballs.

11 Claims, 4 Drawing Sheets

PORTABLE BALL THROWING APPARATUS

BACKGROUND OF THE INVENTION

This invention relates to ball throwing devices, and more particularly to a ball throwing apparatus of minimum size and unique construction.

Ball throwing apparatus of the prior art are capable of throwing baseballs and softballs with a reproducible accuracy and variable speeds for the batting practice of players. However, they are characterized by complex construction and costly manufacture. Most are large and heavy and cumbersome to transport and manipulate.

SUMMARY OF THE INVENTION

This invention provides a portable ball throwing apparatus in which a simplified main support plate mounts adjustable ball feeding and projecting components. The main support plate is mounted pivotally on a tripod leg and hub assembly which is adjustable for use at selected vertical heights for baseball and softball practice.

The principal objective of this invention is the provision of ball throwing apparatus that overcomes the limitations and disadvantages of prior ball throwing apparatus.

Another object of this invention is the provision of ball throwing apparatus of the class described that is small in size for convenient hand transport to a playing field from the trunk of a conventional automobile.

Still another objective of this invention is the provision of ball throwing apparatus of the class described that includes segmented legs which facilitate collapsing of the apparatus to minimum dimensions for carrying and storage in a closure bag.

A further objective of this invention is the provision of ball throwing apparatus in which segmented legs are configured for adjusting the vertical elevation of the ball throwing components between baseball and softball delivery levels.

A still further objective of this invention is the provision of ball throwing apparatus of the class described in which the simplified components are adjustable on three axes for varying the line of travel of a ball.

The foregoing and other objects and advantages of this invention will appear from the following detailed description, taken in connection with the accompanying drawings of a preferred embodiment.

DESCRIPTION OF THE PREFERRED EMBODIMENTS

Figure 1:
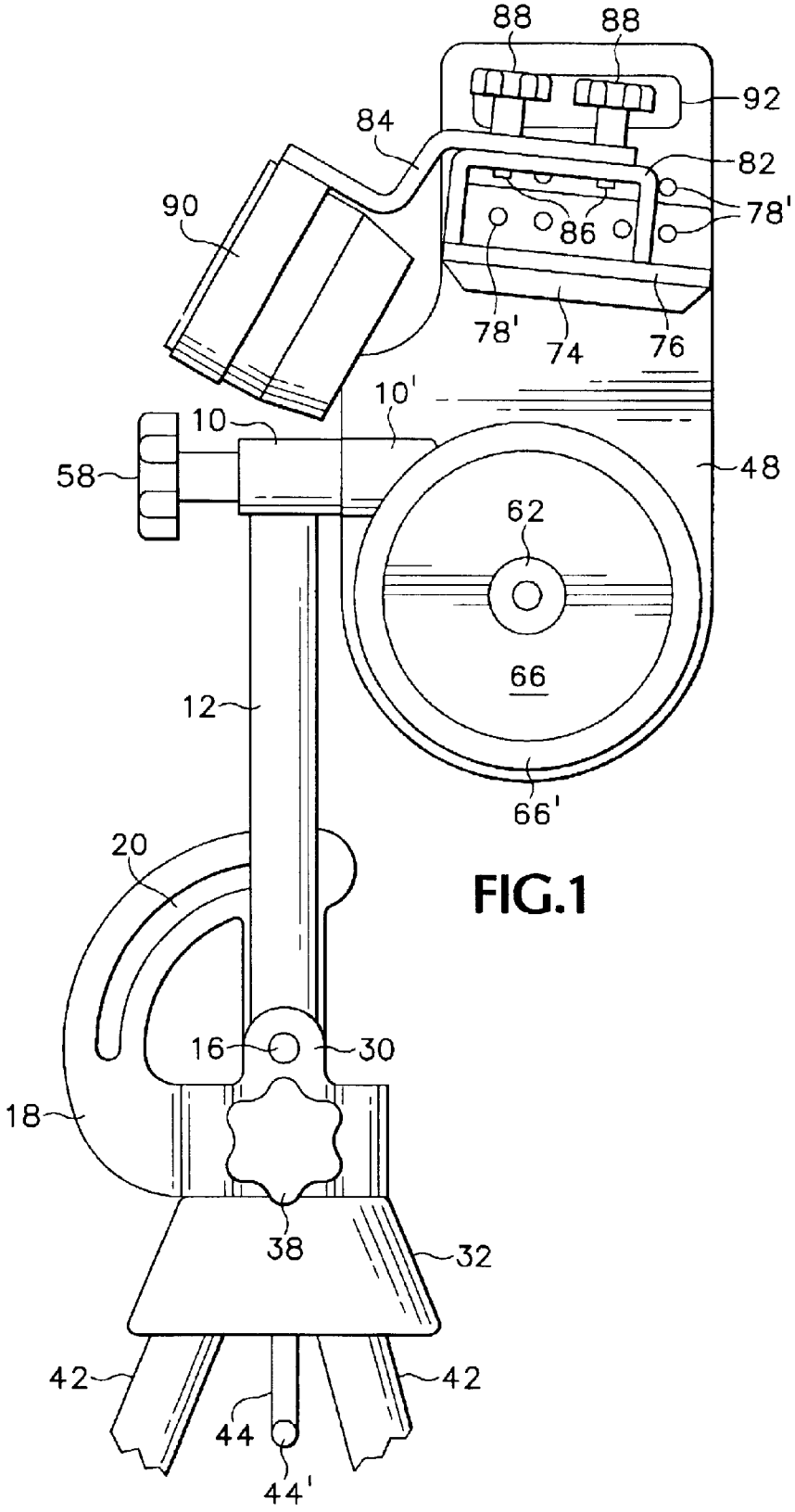
FIG. 1 is a fragmentary side elevation of a portable ball throwing apparatus embodying the features of this invention.
Figure 2:
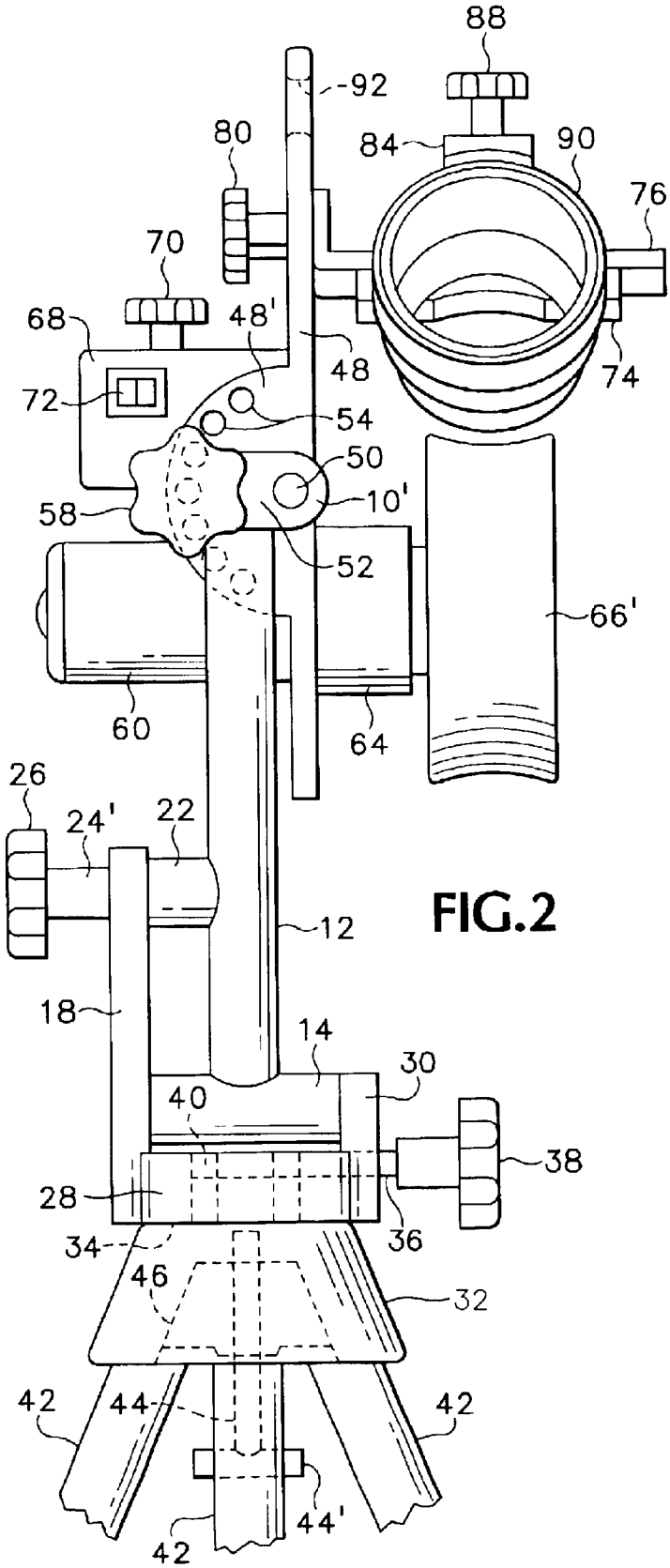
FIG. 2 is a fragmentary rear elevation as viewed from the left in FIG. 1.

The embodiment shown in the drawings includes base means which includes a horizontal bearing member 10 welded or otherwise secured to the upper end of a vertical post member 12. The lower end of the post is joined to pivot bearing 14 (FIG. 2) which supports pivot shaft 16 (FIG. 1). The bearing 14 forms an integral part of a slotted plate 18 which projects laterally from the post 12 and is provided with an arcuate slot 20 formed about the axis of pivot shaft 16.

Figure 3:
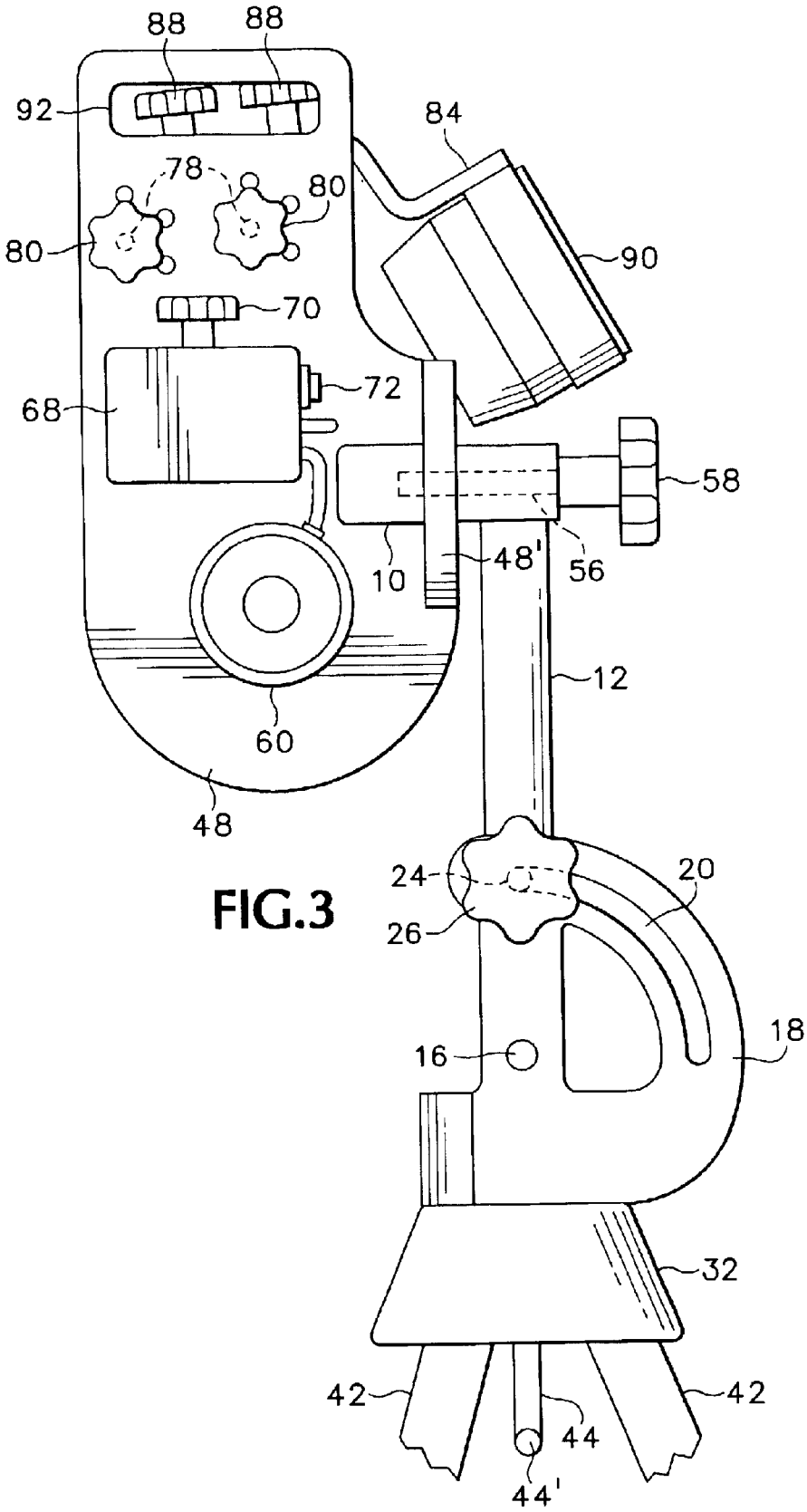
FIG. 3 is a fragmentary side elevation as viewed from the left in FIG. 2.

A screw support 22 (FIG. 2) secured to post 12 has a threaded bore arranged to receive the threaded shank end of a screw 24 (FIG. 3). The intermediate portion of the screw is unthreaded and extends slidably through the arcuate slot 20. An outer portion 24' is enlarged in diameter and may be tightened against the slotted plate 18 by means of the hand knob 26, to secure the post in any desired position of angular adjustment as it is pivoted about the axis of pivot shaft 16.

Also integral with the bearing 14 and slotted plate 18 is an annular sleeve 28 and support bracket 30 for the bearing 14. A tripod leg support hub member 32 has a reduced diameter upper end section 34 (FIG. 2) configured for rotation within the sleeve 28. A set screw 36, with hand knob 38, extends radially through the sleeve for releasable engagement in an annular groove 40 in the upper end section 34 of the tripod hub 32, to secure the base in any desired position of rotation about the axis of the sleeve and post 12.

The hub 32 is provided with circumferentially spaced arcuate slots configured to receive the upper ends of three tripod legs 42 which diverge downwardly from the hub in tripod form. A clamp screw 44, with T-handle 44' is mounted in a threaded bore in the hub for releasably securing a tapered clamp member 46. The clamp member is provided with arcuate sockets arranged to match the sockets in the hub 32, to releasably secure the upper ends of the tripod legs to the hub, in a manner suggested in U.S. Pat. No. 3,774,584 which has common ownership with this invention.

The horizontal base member 10 includes an integral side section 10' which mounts a main support plate 48 by pivot shaft 50. An arm 52 supported on pivot shaft 50 extends parallel to an integral segment 48' of the plate 48 which extends perpendicularly from the plate. The segment is provided with a plurality of arcuately spaced apart index holes 54 disposed about the axis of shaft 50. The arm 52 mounts a screw 56 (FIG. 3) one end of which has a hand control knob 58 and the opposite end of which is configured to be received removably in any selected one of the holes 54. The plate 48 and segment 48' thus are rotatable adjustably about the axis of pivot shaft 50, for purposes described hereinafter.

The main support plate 48 also mounts an electric drive motor 60 an output shaft 62 of which projects through the plate 58 for connection to the hub 64 of a ball-engaging wheel member 66 which includes tire 66'. Although the tire illustrated in the drawings is of a solid type with a concave outer surface, it may be a conventional pneumatic type of tire, as desired.

The drive motor 60 is of the variable speed type and preferably is of the direct current type to enable the alternative use of battery source of electric potential or, as shown, an AC-DC converter. A housing 68 secured to plate 48 contains speed adjustment control means 70, for example a rheostat or potentiometer, for adjusting the rotational speed of the wheel tire 66'. An electric switch 72 on the housing serves to turn the drive motor on and off.

Also supported by the plate 48 is a ball engagement pad 74 secured to an angle bracket 76 attached to plate 48 adjustably by screws 78 provided with hand knobs 80. A plurality of threaded holes 78' are provided for selectively receiving screws 78 to adjust the position of the pad. The pad is disposed above the tire 66' a distance slightly less than the diameter of a ball to be thrown. The angle bracket 76 also mounts a U-shaped bracket 82 (FIG. 1) which, in turn, adjustably mounts a bracket 84 by screws 86 provided with knobs 88. The bracket 84 mounts a ball delivery feed 90 which is positioned rearwardly of the tire 66' and pad 74 for introducing a ball into the space between them. The ball thus is ejected forwardly from between the tire and pad at a preset speed and direction toward a selected location adjacent a practicing batter. Adjustment screws 86 allow adjustment of the ball feeder 90 relative to the tire 66' and pad 74.

Figure 4:
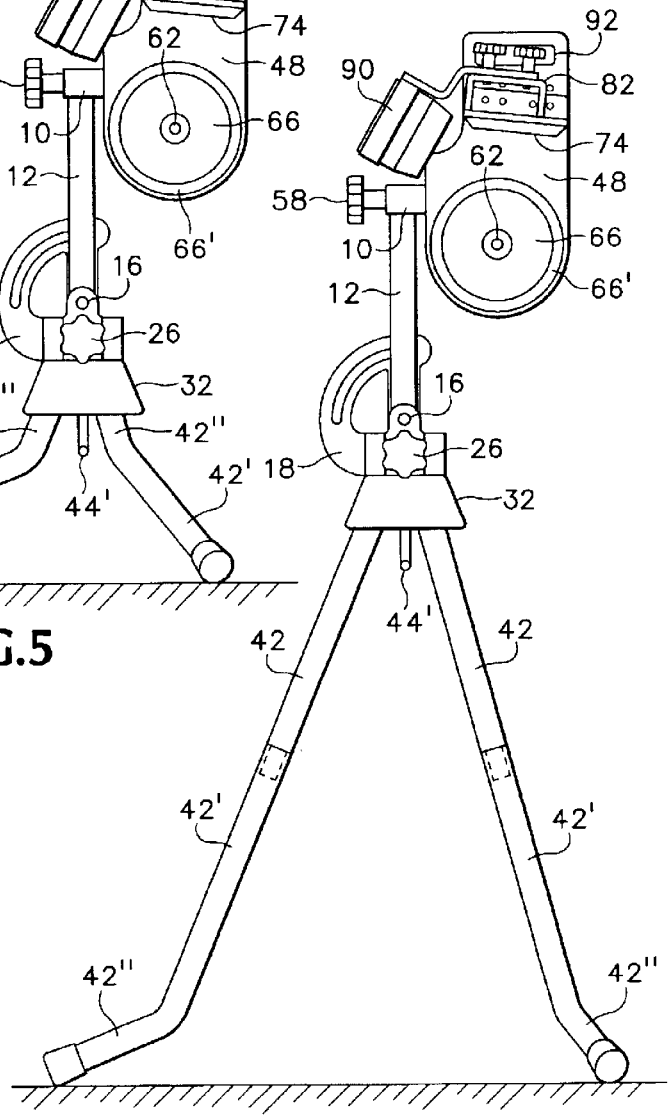
FIG. 4 is a side elevation similar to FIG. 1 and illustrating the sectional arrangement of the tripod support legs for baseball practice and to accommodate disassembly for storage and transport in a carrying bag.

A handle 92 is formed in the upper end of the plate 48 to facilitate carrying the apparatus, for example from the trunk of an automobile to the playing field. To facilitate transport, the tripod legs 42 preferably are provided in segmented form. FIG. 4 shows the leg segments 42 and 42' provided with interconnecting male and female threaded end portions 94. By this means the legs may be shortened in length to facilitate collapsing the apparatus to minimum dimensions for carrying and storage in a closure bag.

Figure 5:
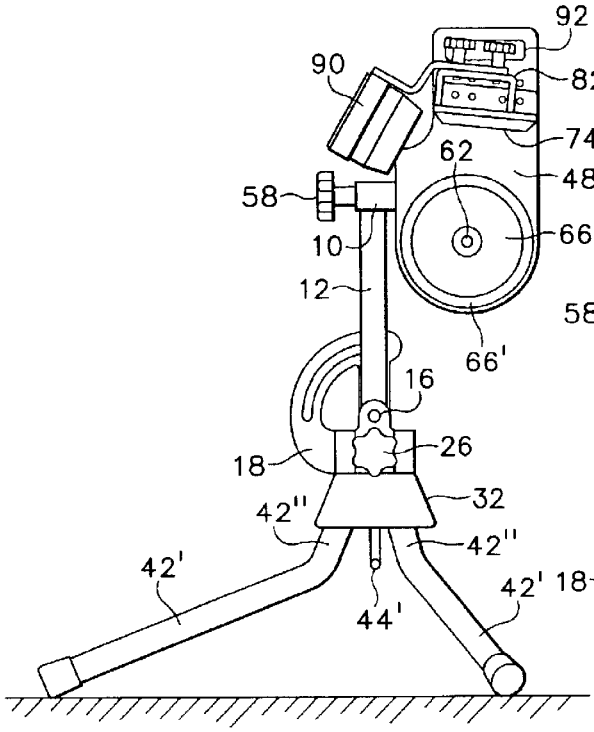
FIG. 5 is a side elevation similar to FIG. 4 illustrating the arrangement of legs which lower the elevation of the ball throwing components for use for softball practice.

The segmented legs also accommodate adjustment of the height of the ball throwing components selectively for use in baseball and softball practice. FIG. 5 shows the use only of the lower leg segments 42' of FIG. 4 which are provided with a short bent section 42". In FIG. 4 these bent sections rest upon the ground. In FIG. 5, these bent sections are secured in the hub 32 so that the segments 42' splay outwardly and lower the ball throwing components for softball practice.

The use and operation of the apparatus described hereinbefore is as follows: The carrying bag which contains the components of the apparatus is removed from the truck of an automobile and carried to the playing field in the vicinity of the pitcher's mound. The components of the apparatus are removed from the bag, the leg segments 42 and 42' are coupled together by the threaded interconnections 94, and the upper ends of the leg segments 42 are placed in the sockets in the hub 32. The clamp 46 is positioned inwardly of the legs and the sockets in the clamp are aligned with the legs. The clamp screw 44 is threaded into the threaded opening in the hub 32, by means of the T-handle 44' to secure the legs to the hub. The assembled unit then is raised to vertical position for baseball practice and the tripod leg assembly is oriented with two of the three legs facing forward and the third leg facing rearward.

If softball practice is desired, the leg segments 42 and 42' are separated and the lower segments 42' are reversed, end-to-end, and the short bent sections 42" are secured in-the hub 32, as previously disclosed.

The screw knob 38 is rotated to loosen the screw and retract it from the annular groove 40 to allow the assembly supported on hub 32 to rotate about the axis of post 12 until the direction of the rotary wheel 66 faces the home plate position for batting pratice, or any other position for fielding practice. The hand knob 38 then is rotated to tighten the screw 36 into the groove 40 to secure the adjusted position.

To adjust the trajectory of the ball pitched from between the tire 66' and pad 74, the knob 26 is loosened and the components mounted on the post are rotated about the axis of pivot shaft 16. When the desired trajectory is achieved, the knob 26 is tightened against the slotted plate 18 to secure the trajectory setting.

In the event it is desired for the apparatus to throw a curve ball, the hand knob 58 is loosened to retract the screw 56 from the opening 54 in the plate segment 48', to allow rotation of the plate 48 and the supported components about the horizontal axis of pivot shaft 50. When the desired angle is achieved, it is secured by rotating the hand knob 58 to extend the screw 56 into the selected opening 54.

Rotation of the ball projecting wheel 66 and tire 66' is achieved by manipulating the on/off switch 72 to complete the electric circuit to the drive motor 60. Adjustment of the speed control 70 brings the tire 66' to a desired speed appropriate for the desired ball delivery speed.

It will be apparent to those skilled in the art that various changes may be made in the size, shape, type, number and arrangement of parts described hereinbefore without departing from the spirit of this invention and the scope of the appended claims.

We claim:

1. Ball throwing apparatus, comprising:

a) a main frame member, b) ball projecting wheel means on the frame member for projecting a ball to a practicing player, c) electric power means on the frame member for rotating the wheel means at selected-speeds, d) support means for mounting the main frame member for adjustment about horizontal and vertical axes, the support means including a vertical post member, first pivot means mounting the main frame member on the upper end portion of the post member for adjustable rotation about a horizontal axis, and second pivot means on the lower end portion of the post member for adjustable rotation about a horizontal axis perpendicular to the axis of the first pivot means, and e) tripod leg means for mounting the support means in ball playing position, the support means including third pivot means mounting the second pivot means on the tripod leg means for adjustable rotation about a vertical axis.

2. The ball throwing apparatus of claim 1 including lock means interengaging the support means and the post member for securing the main frame member in selected positions of rotation about the axis of the first pivot means.

3. The ball throwing apparatus of claim 1 including lock means interengaging the third pivot means and post member for securing the post member in selected positions of rotation about the axis of the second pivot means.

4. The ball throwing apparatus of claim 1 wherein the tripod leg means is formed of a plurality of legs each having a plurality of leg segments secured together removably in longitudinal extension, one of the leg segments of each leg being bent angularly for alternatively forming the lower end of each tripod leg means for engaging the ground and alternatively forming the upper end of each tripod leg means for connection to the support means.

5. The ball throwing apparatus of claim 4, wherein the alternative formations of the bent leg segments varies the vertical elevation of the ball projecting wheel means for throwing baseballs and softballs.

6. The ball throwing apparatus of claim 1 wherein the main frame member is a flat plate, and the support means comprises a vertical post member, first pivot means mounting the flat plate on the upper end portion of the post member for adjustable rotation about a horizontal axis, second pivot means on the lower end portion of the post member for adjustable rotation about a horizontal axis perpendicular to the axis of the first pivot means, and third pivot means mounting the second pivot means on the tripod leg means for adjustable rotation about a vertical axis.

7. The ball throwing apparatus of claim 1 wherein the tripod leg means comprises a plurality of tripod legs each having segments secured together removably in longitudinal extension for forming each of the tripod legs, one of the leg segments being bent angularly for alternatively forming the lower end of each tripod leg means for engaging the ground ad alternatively forming the upper end of each tripod leg means for connection to the support means.

8. The ball throwing apparatus of claim 1 wherein lock means interengages the main leg member and the post member for securing the main frame member in selected positions of rotation about the axis of the first pivot means, and lock means interengages the third pivot means and post member for securing the post member in selected positions of rotation about the axis of the second pivot means.

9. The ball throwing apparatus of claim 1 wherein the tripod leg means comprises a plurality of leg segments secured together removably in longitudinal extension for forming each of the tripod legs, one of the leg segments being bent angularly for alternatively forming the lower end of each tripod leg means for engaging the ground and alternatively forming the upper end of each tripod leg means for connection to the support means.

10. The ball throwing apparatus of claim 1 wherein the support means comprises a vertical post member, first pivot means mounting the main frame member on the upper end portion of the post member for adjustable rotation about a horizontal axis, second pivot means on the lower end portion of the post member for adjustable rotation about a horizontal axis perpendicular to the axis of the first pivot means and third pivot means mounting the second pivot means on the tripod leg means for adjustable rotation about a vertical axis, lock means interengages the main frame member and post member for securing the main frame member in selected positions of rotation about the axis of the first pivot means, lock means interengages the third pivot means and post member for securing the post member in selected positions of rotation about the axis of the second pivot means, and the tripod leg means comprises a plurality of leg segments secured together removably in longitudinal extension for forming each of the tripod legs, one of the leg segments being bent angularly for alternatively forming the lower end of each tripod leg means for engaging the ground and alternatively forming the upper end of each tripod leg means for connection to the support means.

11. Ball throwing apparatus comprising:

a) a flat plate main frame member, b) ball projecting wheel means comprising a rotary wheel and a pad spaced from the wheel slightly less than the diameter of a ball to be projected, electric power means on the flat plate frame member, c) support means comprising a vertical post member, first pivot means mounting the main frame member on the upper end portion of the post member for adjustable rotation about a horizontal axis, second pivot means on the lower end portion of the post member for adjustable rotation about a horizontal axis perpendicular to the axis of the first pivot means, and third pivot means mounting the second pivot means on a tripod leg means for adjustable rotation about a vertical axis, and d) tripod leg means comprising a plurality of leg segments secured together removably in longitudinal extension for forming each of the tripod leg means and one of the leg segments being bent angularly for alternatively forming the lower end of each tripod leg means for engaging the ground and alternatively forming the upper end of each tripod leg means for connection to the support means, the alternative formations effecting adjustment of the vertical elevation of the ball projecting means for accommodating the selective throwing of baseballs and softballs.

* * * * *